United States Patent [19]

Hiraishi et al.

[11] 4,397,483

[45] Aug. 9, 1983

[54] PRESSURE SENSITIVE RECORDING PAPER

[75] Inventors: Shigetoshi Hiraishi, Tokyo; Sadao Morishita, Ibaraki; Toshihiko Matsushita, Funabashi, all of Japan

[73] Assignee: Mitsubishi Paper Mills, Ltd., Tokyo, Japan

[21] Appl. No.: 312,170

[22] Filed: Oct. 15, 1981

[30] Foreign Application Priority Data

| | | | |
|---|---|---|---|
| Oct. 17, 1980 | [JP] | Japan | 55-145505 |
| Nov. 12, 1980 | [JP] | Japan | 55-158187 |
| Dec. 11, 1980 | [JP] | Japan | 55-174978 |

[51] Int. Cl.[3] ..... B41M 5/16; B41M 5/22

[52] U.S. Cl. ..... 282/27.5; 421/150; 421/151; 428/207; 428/211; 428/321.3; 428/321.5; 428/488; 428/535; 428/537; 428/914

[58] Field of Search ..... 282/27.5, 28 R; 428/321.1, 321.3, 321.5, 914, 207, 211, 320.4, 320.6, 320.8, 484–486, 488, 535, 537; 427/150, 151

[56] References Cited

U.S. PATENT DOCUMENTS

| | | | |
|---|---|---|---|
| Re. 30,116 | 10/1979 | Maalouf | 282/27.5 |
| 2,382,828 | 8/1945 | Staneslow | 282/27.5 |
| 3,432,327 | 3/1969 | Kan et al. | 282/27.5 |

*Primary Examiner*—Bruce H. Hess

*Attorney, Agent, or Firm*—Cushman, Darby & Cushman

[57] ABSTRACT

There are disclosed three kinds of pressure sensitive recording papers obtained by combining a colored oil-soluble dye, a microcapsule containing organic liquid and a whitening agent. These pressure sensitive recording papers have advantages that a record image of sufficient color density can be obtained by using said dye in only a small quantity, they are resistant to light, heat, chemicals, etc., they are excellent in conservability, and so on.

7 Claims, No Drawings

PRESSURE SENSITIVE RECORDING PAPER

This invention relates to a pressure sensitive recording paper.

The hitherto used pressure sensitive recording papers are roughly classified into two types. The first type of ones are pressure sensitive recording papers in which a colorless electron-donating color former (leuco dye) is combined with a colorless electron-accepting color developer. That is, a coated back sheet with a microcapsule containing a non-volatile organic solvent in which a colorless electron-donating color former is dissolved is superposed on a coated front sheet with a colorless electron-accepting color developer capable of reacting with said color former at room temperature, so that the coated surfaces of the two sheets confront each other, and a pressure is applied with a ball-point pen, a pencil or the like from upside of the coated back sheet. Thus, the microcapsule is ruptured and the color former contained therein moves together with the solvent towards the coated front sheet, where it reacts with the color developer to give a colored record image. In this type of pressure sensitive recording papers, the coated back sheet and coated front sheet are both colorless before use so that they do not stain hands nor cloths and their appearance is also good. However, they have faults that the colorless color former and color developer are both expensive and the colored record image formed therefrom is poor in conservability and readily discolored by the action of sunlight, humidity and heat, etc.

The other type of pressure sensitive recording papers are those in which a colorant such as colored dye or pigment is used. One of their typical examples is back-carbon transfer paper. It is produced by coating a colorant and a wax or the like to back side of a substrate, or by dissolving or dispersing a colorant into an oil and reserving the resulting solution in a porous layer formed on the back side of a substrate. In the case of this type of recording papers, their colored surface is superposed on a plain paper and a pressure is applied from the side of transfer sheet, whereby a record image is formed on the plain paper. Although the record image formed by the use of this type of transfer papers is excellent in conservability and shows no change with time, the transfer paper has a colorant layer comprising a colored dye or a pigment so that the colored materials can stain hands or cloths upon their use and they are not liked also from the viewpoint of appearance.

Thus, with the aim of reforming the faults of both the types of pressure sensitive recording papers, there have been proposed several processes for preparing a transfer paper having a transfer layer which has been prepared by whitening a colorant layer prepared from a colorant such as colored dye, pigment or the like, and for obtaining therewith a record image on a plain paper. Many of such processes comprise coating a white pigment, a plastic or the like onto a colorant layer to whiten it. Among them, one to be particularly referred to is the process disclosed in Japanese Patent Publication No. 43,570/74 and Japanese Patent Publication No. 14,567/75 which comprises providing a whitening layer on a colorant layer containing a colorant. When a pressure is applied to the coating layer either directly or through intermediation of a sheet coated with a solvent-containing microcapsule superposed thereon, the upper whitening layer becomes transparent, the under colorant layer becomes apparent and a record image is produced. Another process to be referred to is that disclosed in Japanese Patent Publication No. 27,258/69, Japanese Patent Publication No. 9,622/70 and Japanese Patent Publication No. 1,723/71 which comprises coating a colorant layer and a whitening layer on the back side of one sheet. When a pressure is applied, both the layers simultaneously transfer onto another sheet of paper where the colorant layer becomes apparent and produces a record image. However, all these processes require to form a multi-layer coating having two or more layers which increases the number of production steps and enhances the cost. If it is intended to whiten the colorant layer to a particular extent, the thickness of the upper whitening layer must be increased to that extent which injures the characteristic properties of recording paper. Further, since the record image has the color of the colorant itself, a large quantity of colorant must be used for achieving a high color density.

The present inventors have conducted studies and as the result found that the three kinds of pressure sensitive recording papers (A), (B) and (C) mentioned below can overcome the above-mentioned faults in the prior techniques, based on which this invention was accomplished:

(A) A pressure sensitive recording paper consisting of a transfer sheet and an accepting sheet, wherein said transfer sheet has on its back surface a transfer layer consisting mainly of a microcapsule containing an organic liquid, said accepting sheet has on its front surface an accepting layer consisting mainly of a mixture of a colored oil-soluble dye and a whitening agent, and a record image can be produced by using the transfer sheet and accepting sheet so that their coating layers confront each other;

(B) A pressure sensitive recording paper consisting of a transfer sheet and an accepting sheet, wherein said transfer sheet has on its back surface a transfer layer consisting mainly of a mixture of a colored oil-soluble dye and a whitening agent, said accepting sheet has on its front surface an accepting layer consisting mainly of a microcapsule containing an organic liquid, and a record image can be produced by using the transfer and accepting sheets so that their coating layers confront each other;

(C) A pressure sensitive recording paper, wherein its transfer sheet has on its back surface a transfer layer consisting mainly of a mixture of a microcapsule containing an organic liquid, a colored oil-soluble dye and a whitening agent, and a record image can be produced on a plain paper by using it so that the transfer layer of said transfer sheet confronts the plain paper.

The pressure sensitive recording paper (A) of this invention will be explained in more detail. An accepting sheet is prepared by coating a paper with a mixture of a small quantity of fine powder of colored oil-soluble dye, a white colored pigment for whitening the latter, and the like. Since the colored oil-soluble dye is finely powdered, it has a low light absorbance and no particularly large amount of white pigment or the like is necessary for whitening the coating layer. If the whitening layer is formed in the form of a single layer, a substantially white colored coating layer can be obtained owing to the low degree of coloring. This is laid under a transfer sheet coated with a microcapsule containing an organic liquid capable of dissolving the colored oil-soluble dye so that their coated layers confront each other, and a pressure is applied by means of typewriter, pencil or the like from the side of transfer sheet. Thus, the microcapsule is ruptured and the released organic liquid comes into contact with the colored oil-soluble dye and dissolves the fine powder of the dye. As the result, the dye gives a feeling of deep color and a clear record image can be obtained. Accordingly, a use of a small quantity of the dye is enough to produce a record image having a sufficient color density, which is advantageous economically.

It is also allowable to provide a transfer layer and an accepting layer on the back surface and the front surface of one sheet, separately. In this case, there is a danger that, due to the pressure, heat or the like at the time of printing or coating, a part of the microcapsule ruptures and the organic liquid permeates into the sheet to color its front surface. In order to prevent this, it is preferable to coat the under side of the transfer layer containing the microcapsule with a natural polymer, a synthetic polymer or the like as a permeation-proofing agent or to previously treat both sides of the sheet by means of size press. By using plural sheets so that transfer layer and accepting layer confront each other, two or more sheets of records can be obtained simultaneously. The record image thus obtained is resistant to light, heat, chemicals, etc. and excellent in conservability.

Pressure sensitive recording paper (A) according to this invention is based on the application of the difference in light absorbance between the solid state of colored dye and its solution state in organic liquid, so that the pressure sensitive recording paper (A) of this invention is entirely different in the mechanism of color formation from the process disclosed in Japanese Patent Publication No. 43,570/74 according to which colored pigment is made apparent by making the whitening layer transparent by the action of organic liquid in the form of a double layer coating.

Next, pressure sensitive recording paper (B) of this invention will be explained in more detail. A transfer ink is prepared by mixing a small quantity of fine powder of colored oil-soluble dye with a whitening agent for whitening the latter and some other materials. Since the colored oil-soluble dye is finely powdered, it has a low light absorbance and no particularly large amount of whitening agent is necessary for whitening it. If the transfer ink is coated on the support in the form of a single layer, its degree of coloring is so low that a transfer sheet having a substantially white colored transfer layer is obtained. The transfer sheet is superposed on an accepting sheet coated with a microcapsule or the like containing an organic liquid capable of dissolving the colored oil-soluble dye so that their coated surfaces confront each other, and a pressure is applied with typewriter, pencil or the like from the side of transfer sheet. Thus, the transfer ink moves to the accepting sheet and simultaneously comes into contact with the organic liquid released from the ruptured microcapsule, and the fine powder of the colored oil-soluble dye dissolves thereinto. As the result, the dye gives a feeling of deep color, and a clear record image is obtained.

Accordingly, a use of a small quantity of the dye is enough to give a record image having a sufficient color density, which is advantageous economically. As above, the pressure sensitive recording paper (B) of this invention is similar to the pressure sensitive recording paper (A) in that it is based on the difference in light absorbance between the solid state of finely powdered colored oil-soluble dye and its solution state in organic liquid and is entirely different in the mechanism of color formation from the prior pressure sensitive recording papers in which a colorant such as a colored dye or the like is simply coated and the color of the colorant itself is directly utilized for the record image.

It is also allowable, still in the pressure sensitive recording paper (B) of this invention, to provide the transfer layer and the accepting layer on the back surface and front surface of one sheet, respectively. In this case, in order to prevent the coloration of the back side caused by the permeation of organic liquid from ruptured microcapsule, it is still preferable to coat the under side of accepting layer containing the microcapsule with a natural polymer, a synthetic polymer or the like as a permeation-proofing agent, or to previously treat both sides of the sheet by means of size press. By using plural sheets so that transfer layer and accepting layer confront each other, two or more sheets of record can be obtained simultaneously.

In the pressure sensitive recording paper (B) of this invention the colored dye is contained in the transfer sheet. Therefore, an accepting sheet stripped off from the transfer sheet after the typing or recording allows no further color formation on itself and allows a clear conservation of the recorded image only, even if an accidental pressing or rubbing is applied onto the accepting sheet after being stripped off. The record image thus obtained is resistant to light, heat, chemicals, etc. so that it is excellent in conservability.

Next, the pressure sensitive recording paper (C) of this invention will be explained in more detail. First, a small quantity of fine powder of colored oil-soluble dye is mixed with a whitening agent for whitening the latter. Since the colored oil-soluble dye is finely powdered, it has a low light absorbance and no particularly large quantity of whitening agent is necessary for whitening it. Further it is also unnecessary to coat an additional layer of whitening agent thereon in order to obtain a sufficient degree of whiteness. Then, a microcapsule containing an organic liquid for dissolving the colored oil-soluble dye, or the like, is mixed into the above-mentioned mixture to prepare a transfer ink. The transfer ink thus obtained is coated on the back side of a substrate to give a pressure sensitive recording paper (C). When it is superposed on substrate such as plain paper and a pressure is applied by means of typewriter, pencil or the like from the side of transfer paper, the microcapsule present on the back surface of the transfer paper is ruptured and the organic liquid released therefrom comes into contact with the fine powder of colored oil-soluble dye. As the result, the colored oil-soluble dye is dissolved and simultaneously transferred onto the plain paper. Thus, the dye gives a feeling of deep color, and a clear record image is obtained on the plain paper. Accordingly, a use of a small quantity of the dye is enough to give a record image having a sufficient color density, which is economical. As above, pressure sensitive recording paper (C) of this invention is similar to pressure sensitive recording papers (A) and (B) in that it is based on the application of the difference in light absorbance between the solid state of finely powdered colored oil-soluble dye and its solution state in an organic liquid, and it is entirely different in the mechanism of color formation from the prior pressure sensitive recording papers in which a colorant such as a colored dye or the like is simply coated and the color of the colorant is directly utilized for the record image. Although pressure sensitive recording papers by the combination of an oil-containing microcapsule and a colorant are disclosed in Japanese Patent Publication No. 2,718/62 and Japanese Patent Laid-Open No. 106,210/78, they are all different from the pressure sensitive recording paper (C) of this invention in construction in that they have a form of double layer coating consisting of an undercoating layer of microcapsule and a thereover formed colorant layer comprising a colorant and further that the colorant is exposed directly on the surface and therefore the back side, i.e. the coated surface, of the pressure sensitive recording paper thus obtained is colored.

If the pressure sensitive recording paper (C) of this invention is used by superposing its plural sheets so that their front surface (uncoated surface) and their back surface (the surface coated with the white colored transfer ink) confront each other, two or more sheets or record can be obtained simultaneously. Even if an accidental pressing or rubbing is applied after production of the record image, no further color formation takes place on the record image so that only the record image can be conserved clearly. Further, owing to the use of a colored dye, the record image is superior in resistances to light, heat, chemicals etc. to the record image formed by the reaction between an electron-donating color former and an electron-accepting color developer, so that it is excellent in conservability.

As the colored oil-soluble dye used in the pressure sensitive recording papers (A), (B) and (C) according to this invention, any colored dyes may be used arbitrarily so far as they have a high solubility in organic liquids. For example, they are selected from the colored dyes of monoazo type, bisazo type, metal complex monoazo type, anthraquinone type, phthalocyanine type, triarylmethane type and the like. As expressed in terms of color index number, their concrete examples include yellow dyes such as 11020, 11021, 12055, 12700, 18690, 18820, 47000 and the like; red dyes such as 12010, 12150, 12715, 26105, 26125, 27291, 45170B, 60505 and the like; green dyes such as 61565 and the like; blue dyes such as 61100, 61705, 61525, 62100, 42563B, 74350 and the like; black dyes such as 12195, 26150, 50415 and the like; and so on. These colored dyes are made into fine powders having a size of 100 μm or less and preferably 80 μm or less and then used either alone or in combination.

As the whitening agent for whitening the coating layer by applying it together with the colored oil-soluble dye, any substances may be used arbitrarily so far as they have a high whiteness. Among such substances, white pigments, celluloses, waxes and metallic soaps are preferable. As said white pigment, inorganic pigments such as barium sulfate, magnesium sulfate, calcium sulfate, zinc oxide, titanium oxide, calcium carbonate, kaolinite, activated clay, acid clay, zeolite, bentonite, talc and the like and organic pigments such as polystyrene, polyethylene urea-formaldehyde resin and the like can be used either alone or in combination.

As said celluloses, nitrocellulose, methyl cellulose, ethyl cellulose, acetocellulose, carboxymethyl cellulose, hydroxyethyl cellulose and the like can be used either alone or in combination.

As said waxes, vegetable waxes such as rice wax, Japan wax, candelilla wax, carnauba wax and the like; animal waxes such as lanolin, beeswax, shellac wax and the like; mineral waxes such as montan wax and the like; and synthetic waxes such as paraffin wax, microcrystalline wax, oxidized paraffin wax, chlorinated paraffin wax, ricinoleic acid amide, lauric acid amide, erucic acid amide, palmitic acid amide, oleic acid amide, 12-hydroxystearic acid, distearyl ketone, ethylenebisstearic acid amide and the like can be used either alone or in combination. Further, as said metallic soaps, sodium stearate, sodium palmitate, potassium laurate, potassium myristate, calcium stearate, zinc stearate, aluminum stearate, magnesium stearate, lead stearate, dibasic barium stearate and the like can be used either alone or in combination.

Further, the white pigments, celluloses, waxes and metallic soaps used as whitening agent may also be used in the form of a mixture thereof.

As the organic liquid to be contained in the microcapsule used in the pressure sensitive recording papers (A), (B) and (C) of this invention, those excellent in the power for dissolving colored oil-soluble dye are preferable, and volatile organic liquids such as benzene, toluene, methyl cellosolve and the like and more preferably non-volatile organic liquids of diarylmethane type, diarylethane type, alkyldiphenyl type, alkylnaphthalene type, chlorinated paraffin type, aromatic ester type, aliphatic ester type, higher alcohols, higher fatty acids and the like can be used either alone or in combination. The microcapsule can be produced by any processes such as interfacial polymerization process, in situ polymerization process, phase separation process, spray drying process and the like.

The transfer sheet and accepting sheet in the pressure sensitive recording papers (A) and (B) of this invention and the transfer sheet in the pressure sensitive recording paper (C) of this invention can be obtained by a process which comprises coating a water-dispersed coating color on the whole surface of a sheet by means of a general coater such as air knife coater or by a process which comprises coating it on the whole or partial surface of a sheet by means of flexographic printing machine or the like. Further, they can also be obtained by coating the colored oil-soluble dye in the form of a coating color dispersed in an organic solvent incapable of dissolving the colored oil-soluble dye. It is also possible to obtain a multi-color pressure sensitive recording paper by portionwise providing the accepting layer by the use of oil-soluble dyes having different colors.

As the sheet used in the pressure sensitive recording papers of this invention, paper is used mainly, although various unwoven cloths, plastic films, synthetic papers, metallic foils or the like or composite sheets prepared by their combination may also be used arbitrarily.

In preparing the coating color for forming the transfer layer and accepting layer of the pressure sensitive recording papers according to this invention, it is possible to add an adhesive or the like for the purpose of retaining the layers on the surface of the sheet and to add a liquidity improver in accordance with the coater or printing machine used. As said liquidity improver, thickener for keeping a constant viscosity, surfactant for improving dispersibility and the like can be referred to, though they are of course non-limitative.

Hereunder, this invention will be explained concretely with reference to examples, wherein parts are by weight.

EXAMPLE 1

Preparation of Pressure Sensitive Recording Paper (A-1)

(1) Preparation of Transfer Sheet

100 Parts of Hisol SAS N 296 (diarylethane type solvent, manufactured by Nippon Petrochemicals Co., Ltd. was emulsified into 200 parts of 5% aqueous solution of ethylene-maleic anhydride copolymer, and pH of the system was adjusted to 4.0. 200 Parts of an aqueous solution of 10 parts of urea and 2 parts of resorcin was added to the emulsion obtained above, and 25 parts of 37% aqueous solution of formaldehyde was added thereto. While keeping the system temperature at 55° C., the mixture was reacted for 3 hours, and then it was cooled. Then pH was adjusted to 8.0 to complete the preparation of microcapsule. 100 Parts of the microcapsule dispersion thus obtained, 8 parts of oxidized starch and water were mixed together to obtain a mixture having a solid content of 25%. It was coated on a paper having a basis weight of 40 g/m$^2$ by means of coating rod and then dried to obtain a transfer sheet.

(2) Preparation of Accepting Sheet

10 Parts of a 30% aqueous dispersion of Oil Violet, 130 parts of zinc oxide, 20 parts of ureaformaldehyde resin, 67 parts of 45% latex of styrenebutadiene copolymer and 380 parts of water were mixed together and stirred sufficiently. Then the mixture was coated on a paper having a basis weight of 40 g/m$^2$ by means of a coating rod and then dried to obtain a substantially white-colored accepting sheet.

The transfer sheet and accepting sheet obtained above were superposed so that their coated surfaces confront each other, and then typed with typewriter IBM 82 C under a typing pressure of 5 from the side of transfer sheet. Thus, a clear red-violet colored record image was obtained on the accepting sheet.

EXAMPLE 2

Preparation of Pressure Sensitive Recording Paper (A-2)

(1) Preparation of Transfer Sheet

60 Parts of hexamethylene diisocyanatetrimethylolpropane adduct as a wall-forming material was added and dissolved into 300 parts of diisopropyl adipate. The oily solution thus obtained was added to a solution of 30 parts of carboxymethyl cellulose and 30 parts of polyvinyl alcohol in 550 parts of water having a temperature of 20° C. with vigorous stirring to form oil droplets having a diameter of 4–8$\mu$, after which the mixture was diluted with 500 parts of water. Then, 60 parts of ethylenediamine was added and the system temperature was elevated to 70° C. to complete the preparation of microcapsule. 100 Parts of the microcapsule dispersion thus obtained, 10 parts of wheat starch, 6 parts of 40% latex of ethylene-vinyl acetate copolymer and 90 parts of water were mixed together and stirred sufficiently, after which the mixture was coated on a paper having a basis weight of 50 g/m$^2$ by means of coating rod and dried to obtain a transfer sheet.

(2) Preparation of Accepting Sheet

10 Parts of a 30% aqueous dispersion of Oil Blue BA (color index No. 61555, manufactured by Chuo Gosei Kagaku K.K.), 100 parts of titanium oxide, 120 parts of 40% paraffin wax emulsion, 67 parts of 45% latex of styrene-butadiene copolymer and 380 parts of water were mixed together and sufficiently stirred, and then the mixture was coated on a paper having a basis weight of 50 g/m$^2$ by means of coating rod and dried to obtain an accepting sheet having a substantially white-colored coating layer.

The transfer sheet and accepting sheet thus obtained were superposed so that their coated surfaces confront each other, and typed from the side of transfer sheet by means of typewriter IBM 82 C under a typing pressure of 5. Thus, a blue-colored record image was obtained on the accepting sheet.

EXAMPLE 3

Preparation of Pressure Sensitive Recording Sheet (B-1)

(1) Preparation of Accepting Sheet

100 Parts of Hisol SAS N 296 (diarylethane type solvent, manufactured by Nippon Petrochemicals Co., Ltd.) was emulsified into 200 parts of 5% aqueous solution of ethylene-maleic anhydride copolymer, and pH of the system was adjusted to 4.0. 200 Parts of an aqueous solution containing 10 parts of urea and 2 parts of resorcin was added to the emulsion, then 25 parts of 37% aqueous solution of formaldehyde was added thereto, and the mixture was reacted for 3 hours while keeping the system at a temperature of 55° C. After the reaction, it was cooled and its pH was adjusted to 8.0 to complete the preparation of microcapsule.

50 Parts of 10% aqueous solution of polyvinyl alcohol was added to the dispersion of microcapsule containing organic liquid, thus obtained, and the mixture was coated on a plain paper having a basis weight of 50 g/m$^2$ by means of coating rod and dried to obtain an accepting sheet.

(2) Preparation of Transfer Sheet

4 Parts of an aqueous dispersion (solid content 25%) of Oil Blue BA (index number 61555, manufactured by Chuo Gosei Kagaku K.K.), 17 parts of a latex (solid content 48%) of styrene-butadiene copolymer, 60 parts of calcium carbonate (manufactured by Shiraishi Kogyo K.K., trade name Univer 70), 20 parts of zinc oxide (zinc flower No. 1) and 190 parts of water were mixed together and sufficiently stirred, and then the mixture was coated on a plain paper having a basis weight of 50 g/m$^2$ by means of coating rod and dried to obtain a transfer sheet having a substantially white-colored transfer layer.

The accepting sheet and transfer sheet thus obtained were superposed so that their coated surfaces confront each other, and typed from the side of transfer sheet by means of typewriter IBM 82 C under a typing pressure of 5. Thus, a clear blue-colored record image was formed on the accepting sheet.

EXAMPLE 4

Preparation of Pressure Sensitive Recording Paper (B-2)

4 Parts of an aqueous dispersion (solid content 25%) of Oil Black HBB (manufactured by Orient Kagaku Kogyo K.K.), 20 parts of 10% aqueous solution of polyvinyl alcohol, 12 parts of a latex (solid content 48%) of styrene-butadiene copolymer, 70 parts of calcium carbonate, 20 parts of ethyl cellulose and 200 parts of water were mixed together and sufficiently stirred, and the mixture was coated on a plain paper by means of coating rod and dried to obtain a transfer sheet having a white-colored transfer layer. The transfer sheet was superposed on the accepting sheet obtained in Example 3, so that their coated surfaces confront each other, and a typing pressure was applied thereto from the side of transfer sheet by means of typewriter. Thus, a clear black-colored record image was formed on the accepting sheet.

EXAMPLE 5

Preparation of Pressure Sensitive Recording Paper (B-3)

(1) Preparation of Accepting Sheet

20 Parts of a hexamethylene diisocyanate-trimethylolpropane adduct having isocyanate groups, as a wall-forming material, was added and dissolved into 100 parts of diisopropyl adipate. The oily solution thus obtained was added with vigorous stirring into a solution, having a temperature of 20° C., of 10 parts of carboxymethyl cellulose and 10 parts of polyvinyl alcohol in 180 parts of water to form oil droplets having a diameter of 5–8μ, after which the mixture was diluted with 170 parts of water. Then 20 parts of ethylenediamine was added and the system temperature was elevated to 70° C. to complete the preparation of microcapsule.

50 Parts of 10% aqueous solution of polyvinyl alcohol was added to the dispersion of microcapsule containing organic liquid, thus obtained, and the mixture was coated on a paper by means of coating rod and dried to obtain an accepting sheet.

(2) Preparation of Transfer Sheet

4 Parts of an aqueous dispersion (solid content 25%) of Oil Violet, 17 parts of a latex (solid content 50%) of styrene-butadiene copolymer, 20 parts of calcium carbonate, 130 parts of an aqueous dispersion (solid content 40%) of polyethylene wax (degree of polymerization 700) and 80 parts of water were mixed together and sufficiently stirred, and then the mixture was coated on a paper by means of coating rod and dried. Thus, a transfer sheet having a substantially white-colored transfer layer was obtained.

The accepting sheet and transfer sheet obtained above were superposed so that their coated surfaces confront each other, and a typing pressure was applied thereto by means of typewriter from the side of transfer sheet. Thus, a clear red-violet colored record image was formed on the accepting sheet.

EXAMPLE 6

Preparation of Pressure Sensitive Recording Paper (C-1)

100 Parts of Hisol SAS N 296 (diarylethane type solvent, manufactured by Nippon Petrochemicals Co., Ltd.) was emulsified into 200 parts of 5% aqueous solution of ethylene-maleic anhydride copolymer, and pH of the system was adjusted to 4.0. 200 Parts of an aqueous solution containing 10 parts of urea and 2 parts of resorcin was added to the emulsion obtained above, and 25 parts of 37% aqueous solution of formaldehyde was further added, after which the mixture was reacted for 3 hours while keeping the system at a temperature of 55° C. After the reaction, it was cooled and pH was adjusted to 8.0 to obtain a dispersion of microcapsule containing an organic liquid. 20 Parts of the microcapsule dispersion, 4 parts of an aqueous dispersion (solid content 25%) of Oil Blue BA (color index number 61555, manufactured by Chuo Gosei Kagaku K.K.), 38 parts of an aqueous dispersion (solid content 40%) of microcrystalline wax and 117 parts of an aqueous dispersion (solid content 30%) of zinc stearate were mixed together and sufficiently stirred, after which the mixture was coated on the back side of a plain paper having a basis weight of 50 g/m$^2$ by means of coating rod and dried. Thus, a pressure sensitive recording paper having a substantially white colored transfer layer was obtained.

The pressure sensitive recording paper thus obtained with its transfer layer downward was superposed on a plain paper, and typed by means of typewriter IBM 82 C under a typing pressure of 5. Thus a clear blue colored record image was formed on the plain paper.

EXAMPLE 7

Preparation of Pressure Sensitive Recording Paper (C-2)

20 Parts of a hexamethylene diisocyanate-trimethylolpropane adduct having isocyanate groups as a wall-forming material was dissolved into 100 parts of diisopropyl adipate. The oily solution thus obtained was added to a solution, having a temperature of 20° C., of 10 parts of carboxymethyl cellulose and 10 parts of polyvinyl alcohol in 180 parts of water with vigorous stirring to form oil droplets having a diameter of 5–8μ, after which the mixture was diluted with 170 parts of water. Then, 20 parts of ethylenediamine was added and the system temperature was elevated to 70° C. to obtain a dispersion of microcapsule containing an organic liquid. 30 Parts of the microcapsule dispersion, 4 parts of an aqueous dispersion (solid content 25%) of Oil Black HBB (color index number 26150, manufactured by Orient Kagaku Kogyo K.K.), 105 parts of an aqueous dispersion (solid content 40%) of castor wax (manufactured by Kokura Gosei Kogyo K.K.), 48 parts of an aqueous dispersion (solid content 25%) of ethyl cellulose and 6 parts of calcium carbonate were mixed together, after which 40 parts of water was added and sufficiently stirred. The mixture was coated on the back side of a plain paper having a basis weight of 50 g/m$^2$ by means of coating rod and dried. Thus, a pressure sensitive recording paper having a substantially white colored transfer layer was obtained.

The pressure sensitive recording paper thus obtained with its transfer layer downward was superposed on a plain paper and typed with pressure by means of typewriter. Thus, a clear black-colored record image was formed on the plain paper.

The optical densities of the record images obtained in Examples 1–7 and the record images produced by combining the coated back sheet and coated front sheet of commercial pressure sensitive recording papers (Mitsubishi NCR paper manufactured by Mitsubishi Paper Mills, Ltd.) were measured by means of Sakura Densitometer PDA 45 to obtain the results shown in Table 1. In Table 1, there are also shown the optical densities of the faded record images by light resistance test, heat resistance test and chemical resistance test. Herein, the methods of resistance tests were as follows:

Light resistance test: By means of Xenon Fade-o-meter FAL-25X-HCL, the sample was irradiated with xenon light for 3 hours in an atmosphere having a temperature of 40° C. and a humidity of 60%.

Heat resistance test: The sample was kept in an oven having a constant temperature of 60° C. for 24 hours.

Chemical resistance test: The sample was held between polyvinyl chloride sheets and held in an oven having a constant temperature of 60° C. for 20 hours. The effect of the plasticizer exuding out of the polyvinyl chloride sheets was examined.

In Table 1, greater numerical values mean higher optical densities, so that they are more desirable.

It is apparent from the results that the record images obtained in the above-mentioned examples show a sufficient optical density as compared with commercial pressure sensitive recording papers, and further they are excellent in light resistance, heat resistance and chemical resistance examined in the tests.

TABLE 1

| Example | Color shade of record image | Optical density of record image | Optical densities in resistance tests | | | | | |
|---|---|---|---|---|---|---|---|---|
| | | | Light resistance test | | Heat resistance test | | Chemical resistance test | |
| | | | | Δ | | Δ | | Δ |
| 1 | Red-violet | 0.55 | 0.50 | 0.05 | 0.50 | 0.05 | 0.52 | 0.03 |
| 2 | Blue | 0.59 | 0.56 | 0.03 | 0.55 | 0.04 | 0.57 | 0.02 |
| 3 | Blue | 0.68 | 0.65 | 0.03 | 0.64 | 0.04 | 0.66 | 0.02 |
| 4 | Black | 0.64 | 0.60 | 0.04 | 0.60 | 0.04 | 0.62 | 0.02 |
| 5 | Red-violet | 0.65 | 0.60 | 0.05 | 0.61 | 0.04 | 0.62 | 0.03 |
| 6 | Blue | 0.60 | 0.56 | 0.04 | 0.55 | 0.05 | 0.59 | 0.01 |
| 7 | Black | 0.58 | 0.55 | 0.03 | 0.54 | 0.04 | 0.56 | 0.02 |
| Commercial pressure sensitive recording paper 1 | Blue | 0.63 | 0.32 | 0.31 | 0.56 | 0.07 | 0.21 | 0.42 |
| Commercial pressure sensitive recording paper 2 | Black | 0.65 | 0.40 | 0.25 | 0.60 | 0.05 | 0.39 | 0.26 |

What is claimed is:

1. A pressure sensitive recording paper which either (a) consists of a transfer sheet and an accepting sheet, wherein said transfer sheet has on its back surface a transfer layer consisting mainly of microcapsule containing an organic liquid which is a solvent capable of dissolving a colored oil-soluble dye, said accepting sheet has on its front surface a white-colored accepting layer consisting mainly of a mixture of colored oil-soluble dye and whitening agent, and a dark-colored record image can be obtained by using said transfer sheet and said accepting sheet so that their coated layers confront each other, or (b) consists of a transfer sheet and an accepting sheet, wherein said transfer sheet has on its back surface a white-colored transfer layer consisting mainly of a mixture of colored oil-soluble dye and whitening agent, said accepting sheet has on its front surface an accepting layer consisting mainly of microcapsule containing an organic liquid which is a solvent capable of dissolving a colored oil-soluble dye, and a dark-colored record image can be obtained by using said transfer sheet and said accepting sheet so that their coated layers confront each other or (c) is a pressure sensitive recording paper, wherein its transfer sheet has on its back surface a white-colored transfer layer consisting mainly of a mixture of (1) microcapsule containing an organic liquid which is a solvent capable of dissolving a colored oil-soluble dye, (2) colored oil-soluble dye and (3) whitening agent, and a dark-colored record image can be obtained on a plain paper by using said transfer sheet so that its transfer layer confronts the plain paper.

2. A pressure sensitive recording paper according to claim 1 consisting of a transfer sheet and an accepting sheet, wherein said transfer sheet has on its back surface a tansfer layer consisting mainly of microcapsule containing an organic solvent capable of dissolving a colored oil-soluble dye, said accepting sheet has on its front surface an accepting layer consisting mainly of a mixture of colored oil-soluble dye and whitening agent, and a record image can be obtained by using said transfer sheet and said accepting sheet so that their coated layers confront each other.

3. A pressure sensitive recording paper according to claim 2, wherein at least one member selected from the group consisting of white colored pigments, celluloses, waxes and metallic soaps is used as said whitening agent.

4. A pressure sensitive recording paper according to claim 1 consisting of a transfer sheet and an accepting sheet, wherein said transfer sheet has on its back surface a transfer layer consisting mainly of a mixture of colored oil-soluble dye and whitening agent, said accepting sheet has on its front surface an accepting layer consisting mainly of microcapsule containing an organic solvent capable of dissolving a colored oil-soluble dye, and a record image can be obtained by using said transfer sheet and said accepting sheet so that their coated layers confront each other.

5. A pressure sensitive recording paper according to claim 4, wherein at least one member selected from the group consisting of white colored pigments, celluloses, waxes and metallic soaps is used as said whitening agent.

6. A pressure sensitive recording paper according to claim 1, wherein its transfer sheet has on its back surface a transfer layer consisting mainly of a mixture of (1) microcapsule containing an organic solvent capable of dissolving an oil-soluble dye, (2) colored oil-soluble dye and (3) whitening agent, and a record image can be obtained on a plain paper by using said transfer sheet so that its transfer layer confronts the plain paper.

7. A pressure sensitive recording paper according to claim 6, wherein at least one member selected from the group consisting of white colored pigments, celluloses, waxes and metallic soaps is used as said whitening agent.

* * * * *